US007334692B2

(12) United States Patent
Black

(10) Patent No.: US 7,334,692 B2
(45) Date of Patent: Feb. 26, 2008

(54) MODULAR SHELVING SYSTEM

(75) Inventor: Robert E. Black, Depew, NY (US)

(73) Assignee: Wire Weld, Inc., Lockport, NY (US)

( * ) Notice: Subject to any disclaimer, the term of this patent is extended or adjusted under 35 U.S.C. 154(b) by 256 days.

(21) Appl. No.: 11/192,611

(22) Filed: Jul. 29, 2005

(65) Prior Publication Data

US 2007/0023376 A1 Feb. 1, 2007

(51) Int. Cl.
*A47B 43/00* (2006.01)
*A47B 47/00* (2006.01)
*A47B 57/00* (2006.01)

(52) U.S. Cl. ..... 211/187; 211/106; 211/191; 211/207

(58) Field of Classification Search ..... 211/189, 211/190, 175, 207, 181.1, 134, 186, 187, 211/153, 135, 106, 106.01, 103, 133.5, 126.16, 211/126.2, 191; 312/408, 410, 351; 108/106, 108/110

See application file for complete search history.

(56) References Cited

U.S. PATENT DOCUMENTS 2,994,441 A * 8/1961 Browning, Jr. ..... 211/189
3,007,708 A * 11/1961 Ochs ..... 280/33.998
3,101,148 A * 8/1963 Brown ..... 108/163
3,252,434 A * 5/1966 Young, Jr. ..... 108/181
3,602,159 A * 8/1971 Marschak ..... 108/187
3,977,529 A * 8/1976 Stroh ..... 211/187
4,231,298 A * 11/1980 Pollack ..... 108/64
4,391,378 A * 7/1983 Secon ..... 211/187
4,558,647 A 12/1985 Petersen
4,697,712 A * 10/1987 Valiulis ..... 211/187
5,706,741 A * 1/1998 Thorp et al. ..... 108/193
5,833,084 A * 11/1998 Chang ..... 211/187
6,073,786 A * 6/2000 McCorkle, Jr. ..... 211/187
6,422,406 B1 * 7/2002 Kessel et al. ..... 211/181.1
7,234,604 B2 * 6/2007 Eisele ..... 211/187

* cited by examiner

*Primary Examiner*—Jennifer E. Novosad
(74) *Attorney, Agent, or Firm*—Neal L. Slifkin; Robert C. Brown

(57) ABSTRACT

A modular stand-alone shelving system comprising left and right vertical support members, each having front and rear corner posts connected by a welded grid of horizontal and vertical rods. A plurality of shelves formed of sheet metal are disposed between the vertical support members, each shelf including hook elements formed near the corners thereof for engaging and resting on horizontal rods of the grid. A back member extends between the vertical support members and also includes hook elements formed near the corners thereof for engaging and resting on horizontal rods in the grid. Upper corners of the back member include first and second hooks disposed in planes spaced apart by the thickness of the vertical rods. When installed, the hooks rest on horizontal rods and straddle a vertical rod, preventing motion of the back member and rhombic distortion. The back member prevents rhombic distortion in the X and Z directions.

11 Claims, 9 Drawing Sheets

MODULAR SHELVING SYSTEM

BACKGROUND OF THE INVENTION

1. Field of the Invention

The present invention relates to metal shelving assemblies; more particularly, to stand-alone metal shelving assemblies; and most particularly, to a modular stand-alone metal shelving system that is easily assembled without tools.

2. Discussion of the Related Art

Stand-alone metal shelving assemblies are well known. By stand-alone is meant a shelving assembly that does not require a wall for a portion of its support or stability. A stand-alone assembly may be free-standing away from a building wall or other support or stabilizing element.

A prior art modular shelving system is disclosed in U.S. Pat. No. 4,558,647. A modular shelving unit comprises at least two upright members and at least two shelf elements which engage oppositely spaced-apart upright members to form a shelving structure. The upright members are made of a latticework of welded wire which is secured at two opposite edges in support beams (corner posts). The shelf elements are also made of a latticework fixed along two opposite edges thereof in support beams. The support beams of the shelf elements have means at each end for engaging the latticework of an upright member. The latticework of the shelf elements is relatively flexible and may require additional structure and rigidity by means of auxiliary support beams positioned under the shelves for this purpose. The formed structure has relatively little strength against rhombic collapse in the X (sideways) direction. Thus, one or more diagonal turnbuckle assemblies are recommended across the rear of the unit to provide added structural integrity to the shelving to prevent rhombic collapse.

A shortcoming of such a prior art modular shelving system is the fabrication expense of the shelves, which require, first, formation of a welded latticework of wires; second, formation of channel beams for the shelf edges; third, formation of hooks on the ends of the channel beams; fourth, crimping of the ends of the wires for insertion into the beam channels; and fifth, crimping of the beam channels to retain the ends of the wires. Thus, formation of each shelf is a multiple-step, multiple-process operation requiring welding, cutting, stamping, forming, and assembling of multiple components.

A further shortcoming is that the resulting shelf is relatively weak against folding in the Y (front-to-back) direction and requires one or more supplementary beams for heavy loads.

A still further shortcoming is that the shelves are open latticework and therefore are useless for storing small items which cannot stand on the latticework and may even fall through, requiring therefore a supplementary continuous shelf liner.

A still further shortcoming is the lack of inherent rhombic stability, requiring addition of one or more diagonal turnbuckles to prevent rhombic collapse under load.

What is needed in the shelving art is an improved modular metal shelving system wherein an entire stand-alone shelving assembly is easily assembled without need for any tools; wherein each individual shelf may be readily repositioned at a different height; wherein the shelves may be formed inexpensively; wherein the shelves are continuous and thus can fully support objects of any size; wherein the assembly is inherently strong against rhombic collapse in both the X and Z directions; wherein the assembly may be assembled or disassembled rapidly and easily; and wherein the assembly is readily modular.

It is a primary objective of the invention to provide a shelving assembly which is easily assembled without need for any tools, wherein each individual shelf may be readily repositioned at a different height, wherein the shelves may be formed inexpensively, wherein the shelves are continuous and thus can fully support objects of any size, wherein the assembly is inherently strong against rhombic collapse in the X and Z directions, wherein the assembly may be assembled or disassembled rapidly and easily, and wherein the assembly may be readily combined modularly with additional assemblies.

SUMMARY OF THE INVENTION

Briefly described, a stand-alone modular shelving system in accordance with the invention comprises at least two vertical support members, each having a front corner post and a rear corner post connected by a welded grid of horizontal and vertical rods. A plurality of shelves formed of sheet metal are disposed between the vertical support members, each shelf including hook elements formed near the corners thereof for engaging and resting on horizontal rods of the grid. A back member extends between the vertical support members and also includes hook elements formed near the corners thereof for engaging and resting on horizontal rods the grid. In a currently-preferred embodiment, the upper corners of the back member each include first and second formed hooks spaced apart by the distance between adjacent horizontal rods and disposed in planes spaced apart by approximately the thickness of the vertical rods. When installed, the first and second hooks rest on adjacent horizontal rods and also straddle a vertical rod. The back member thus provides diagonal bracing through the sheet metal forming the back, preventing rhombic distortion and collapse in the X and Z directions. Additional shelving assemblies may be added modularly by addition of only one vertical support member, as the vertical support members are symmetrical and accessible equally from either side.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DETAILED DESCRIPTION OF THE INVENTION

Figure 1:
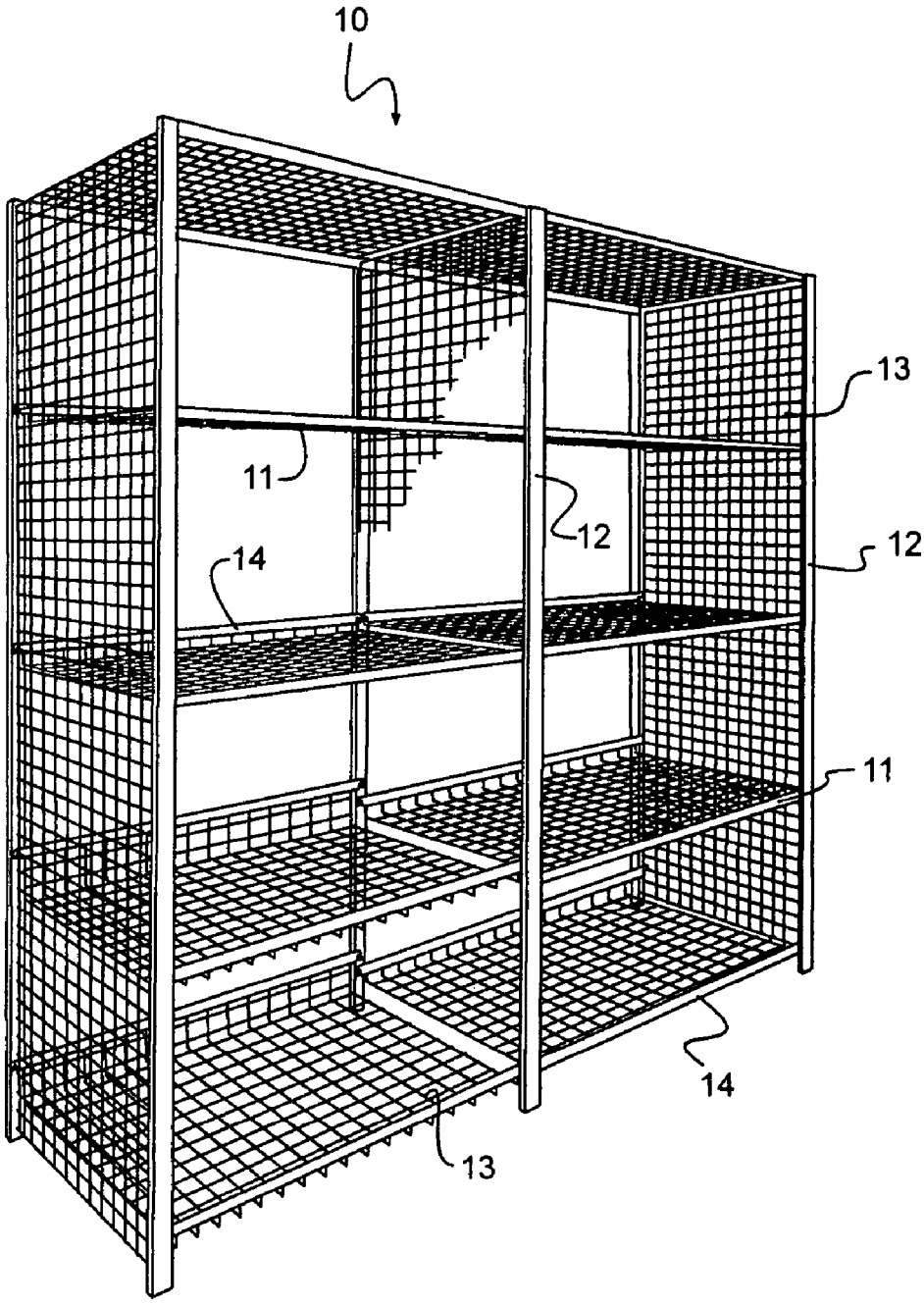
FIG. 1 (PRIOR ART)
FIG. 1 is a perspective view from the left of a prior art stand-alone modular shelving system substantially in accordance with the disclosure of U.S. Pat. No. 4,558,647.
Figure 2:
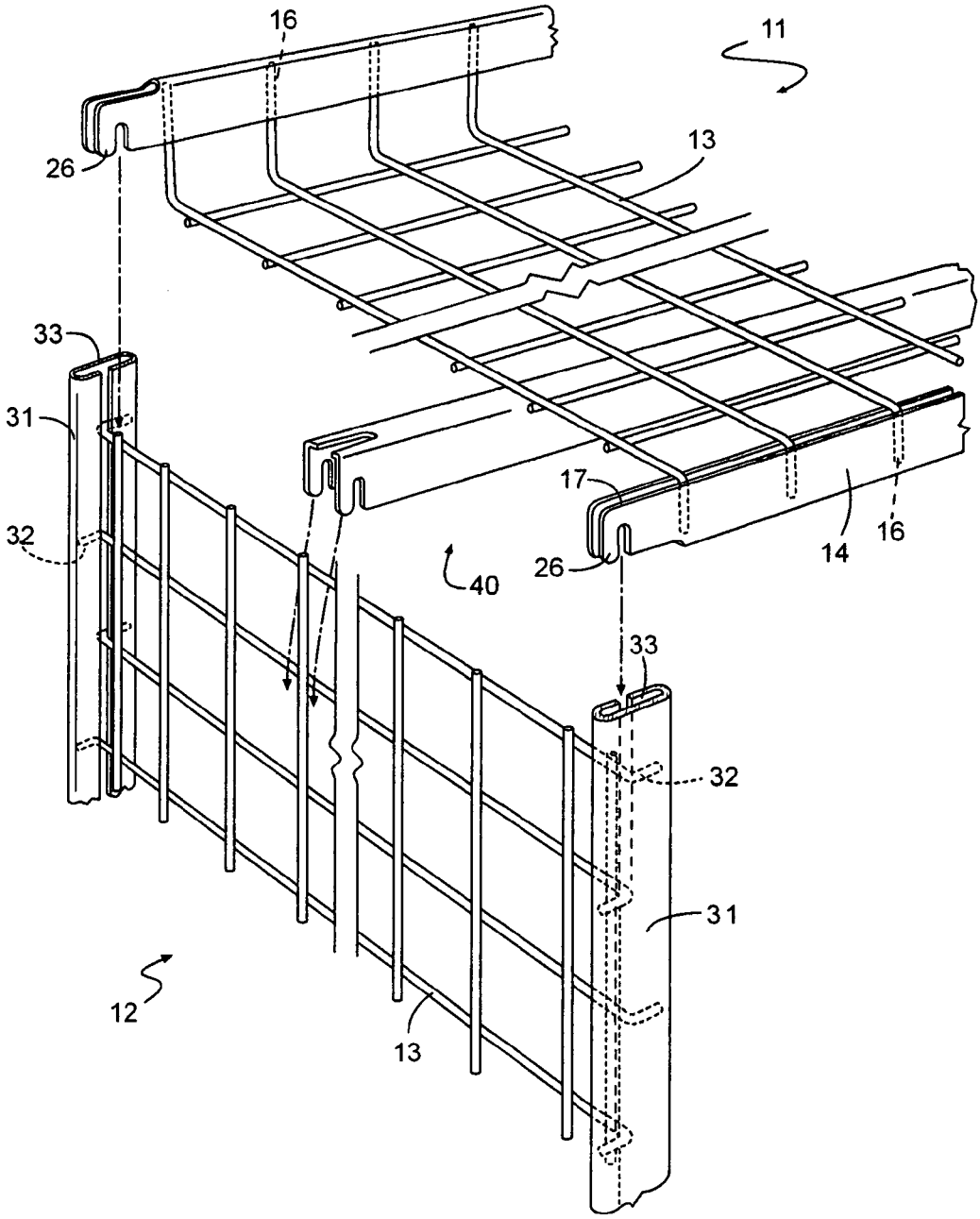
FIG. 2 (PRIOR ART)
FIG. 2 is a detailed view of portions of a vertical latticework element and a shelf element shown in FIG. 1.
Figure 3:
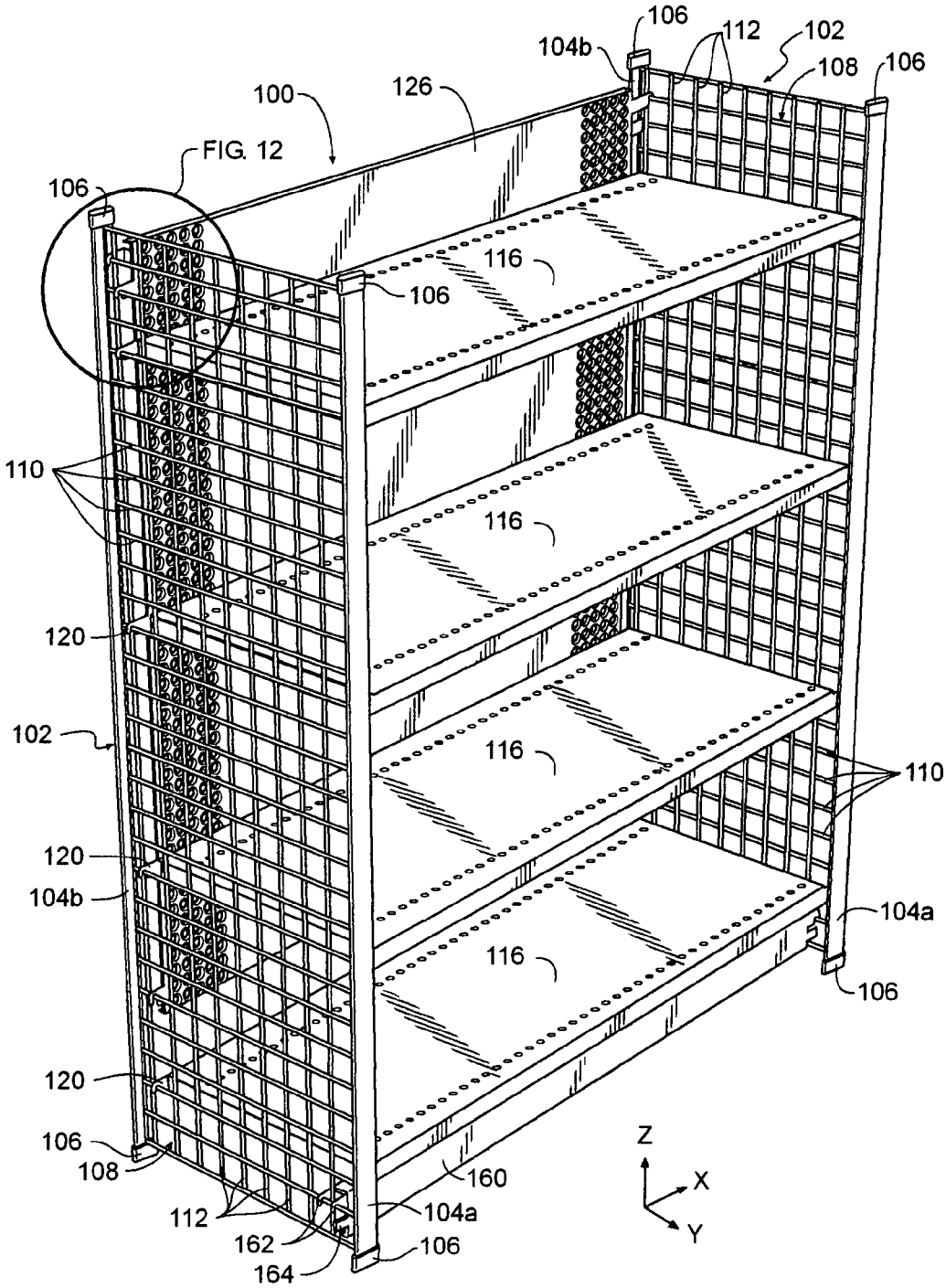
FIG. 3 is a perspective view from above left of a stand-alone shelving system module in accordance with the invention.
Figure 4:
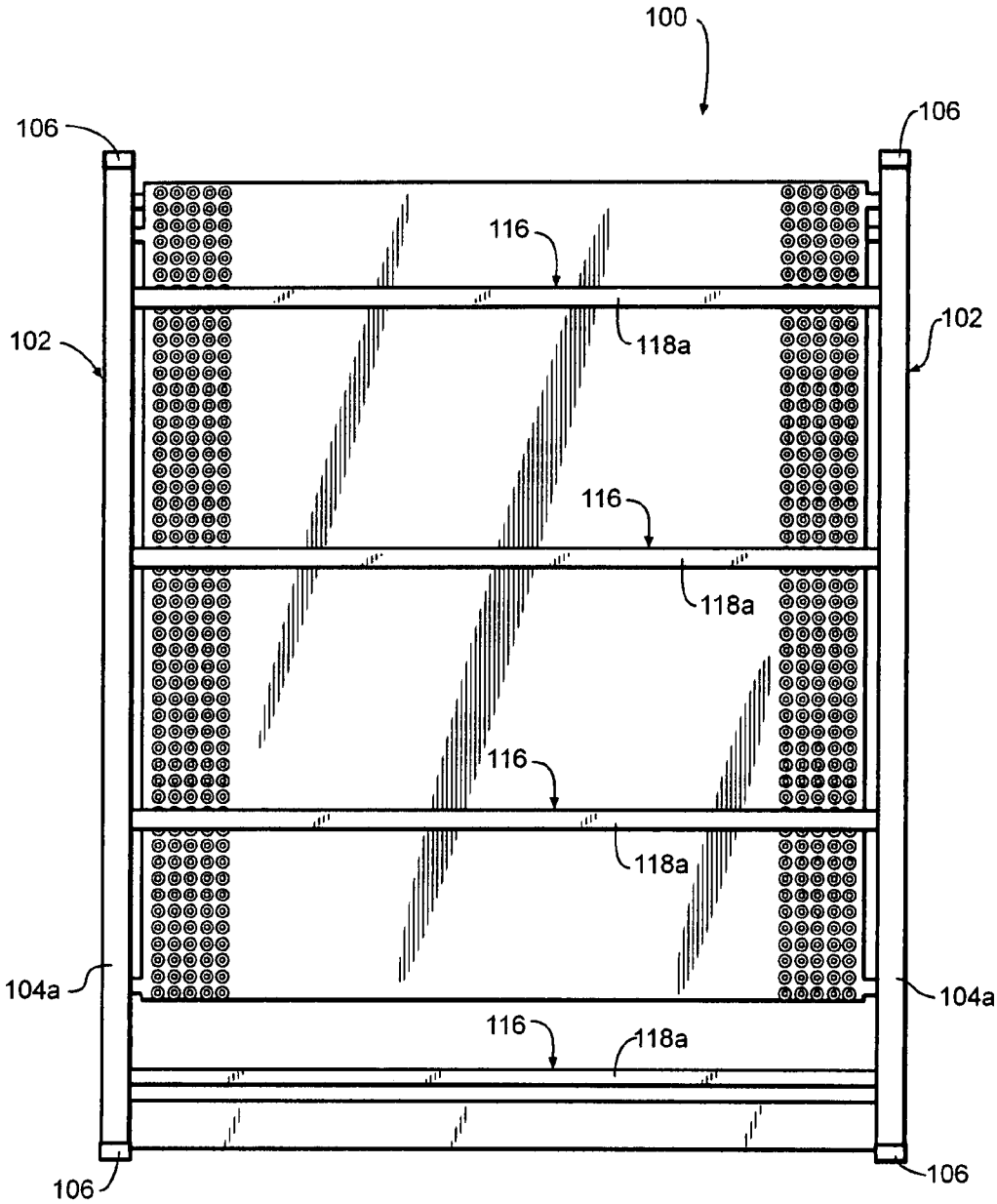
FIG. 4 is a front elevational view of the shelving system module shown in FIGS. 3 and 4.
Figure 5:
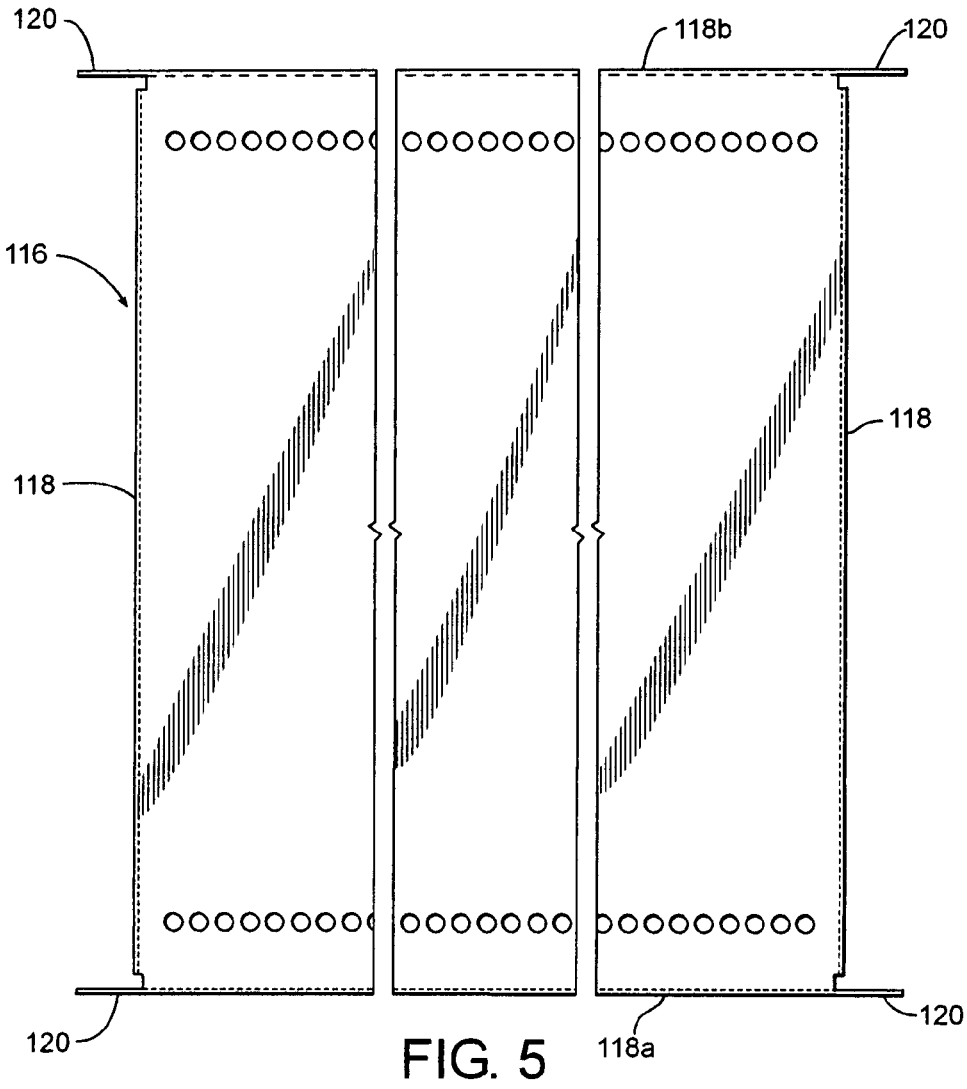
FIG. 5 is a plan view of a typical shelf in the shelving system shown in FIGS. 3 and 4.
Figure 6:
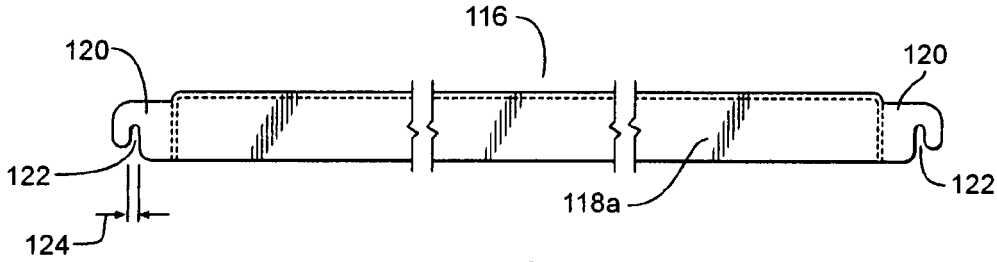
FIG. 6 is a front elevational view of the shelf shown in FIG. 5.

Referring to FIGS. 1 and 2, a prior art free-standing modular shelving assembly 10 comprises shelf elements 11 engaging oppositely spaced upright members 12 to form the shelf structure. FIG. 1 illustrates a double unit, and additional units may be added at either end upright member 12 as desired.

The shelf elements 11 and upright members 12 are preferably made of latticework 13 comprising welded steel wire. The latticework 13 of shelf elements 11 is provided with structure and rigidity by means of support beams 14 fixed along prongs of opposite edges 16 thereof (FIG. 2). Each support beam 14 is made of sheet metal which is bent to provide a U-shaped channel 17 along its length to receive the edge prongs 16 of latticework 13. Beam 14 is preferably 16 gauge steel, and the edge prongs 16 of the latticework 13 are welded in place in beam channel 17.

Support beams 14 of shelf elements 11 are provided at each end thereof with means for engaging upright members 12 so as to form the shelf structure. A hook 26 is formed by providing a slot across the end portion of beam 14 as shown in FIG. 2.

The latticework 13 of the upright members 12 is also provided with support beams 31 which are formed to have a channel of C-shaped cross-section 33 so that the prongs of edges 32 can be bent at alternating right angles for insertion into channel 33.

When extra support is needed for storing heavier articles, an auxiliary support beam 40 may be positioned under shelf element 11 for this purpose. When bracing is required to prevent rhombic collapse in the X and Z directions, wire bracing having hooked ends (not shown) can engage the latticework 13 and be tensioned by means of a conventional turnbuckle (not shown).

The shortcomings of prior art shelving assembly 10 are recited hereinabove and need not be repeated here.

Referring to FIGS. 3 through 14, a free-standing modular shelving system 100 in accordance with the invention comprises spaced-apart first and second identical vertical support members 102 which preferably are interchangeable with each other, as well as side-for-side and end-for-end. Each support member 102 includes first and second corner posts 104*a*,104*b* terminating in wear caps 106. The corner posts are connected along their respective lengths by a rigid grid 108 of horizontal rods 110 and vertical rods 112 welded together at their mutual intersections 114.

A plurality of shelves 116 formed of sheet metal as by stamping and punching are disposed between the spaced-apart vertical support members. Each shelf includes a formed skirt 118 extending orthogonally from the plane of the shelf along all four sides to provide flexural rigidity to the shelf. The front and rear skirts 118*a*,118*b* are extended to define hook elements 120 formed near the four corner regions of each shelf for engaging and resting on horizontal rods 110 of grid 108. Each hook element 120 includes a slot 122 having a width 124 substantially the same as the diameter of a horizontal rod 110 such that the shelf is fixed in the X direction by engagement of the hooks with horizontal rods. Y direction motion is limited by an adjacent vertical rod.

Because hook elements 120 extend beyond the ends of shelves 116, the shelves are easily installed into and removed from vertical members 102. For installation, a shelf is tilted and inserted between members 102, then a horizontal rod 110 is selected for the location of the shelf. Hook elements 120 at one end of the shelf are inserted through grid 108 above the selected rod in one of members 102, allowing the shelf to be brought to horizontal. Hook elements 120 on the opposite end of the shelf are positioned over the corresponding opposite horizontal rod in opposite member 102, the shelf is translated until slots 122 are positioned over the respective selected rods, and then the shelf is lowered to engage the hook elements onto the rods, thus securing the shelf in place. Disassembly is the reverse of assembly.

Thus, all shelves may be installed and removed in system 100 quickly and easily without resort to tools or separate fasteners. Further, shelves may be positioned at any desired height on members 102. Further, shelves may be formed to provide any desired depth of shelf in the Y direction less than and up to the full width of members 102.

A back member 126 formed of sheet metal as by stamping and punching is disposed between the vertical support members 102. Each back member 126 includes a formed skirt 128 extending orthogonally from the plane of the member along all four sides to provide flexural rigidity to the back member. Back member 126 is extended to define hook elements 130 formed near the four corner regions of each back member for engaging and resting on horizontal rods 110 of grid 108. Each hook element 130 includes a slot 132 having a width 134 substantially the same as the diameter of a horizontal rod 110 such that the back member is fixed in the Z direction by engagement of the hooks with horizontal rods.

Figure 8:
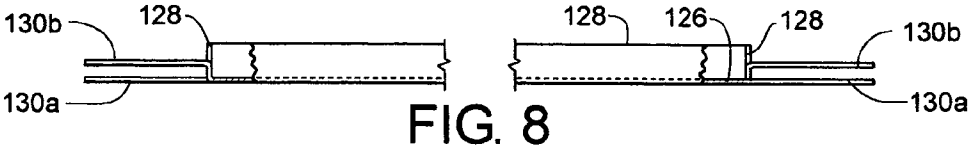
FIG. 8 is a plan view of the back member shown in FIG. 7.
Figure 7:
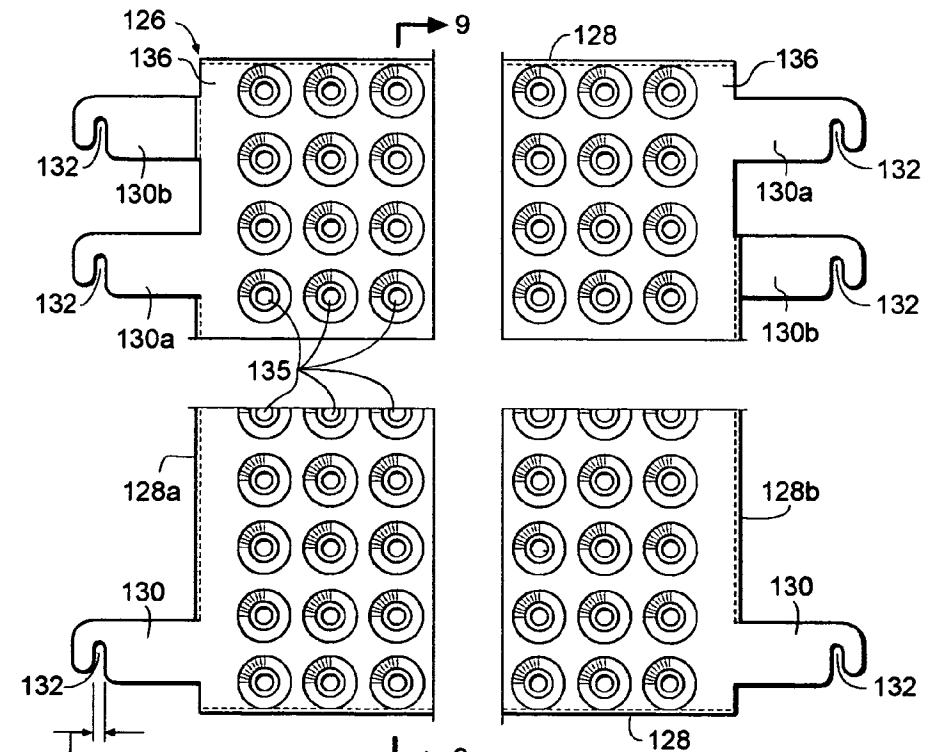
FIG. 7 is an elevational view of a back member shown in FIGS. 3 and 4.
Figure 9:
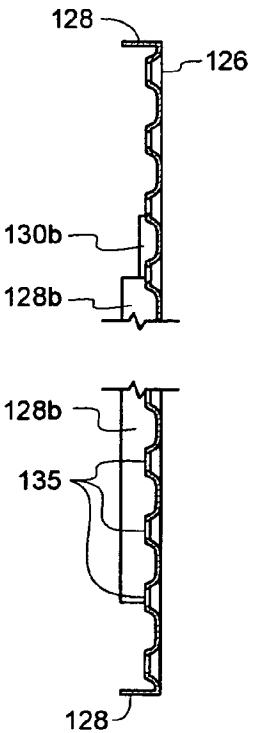
FIG. 9 is a cross-sectional view taken along line 9-9 in FIG. 7.
Figure 10:
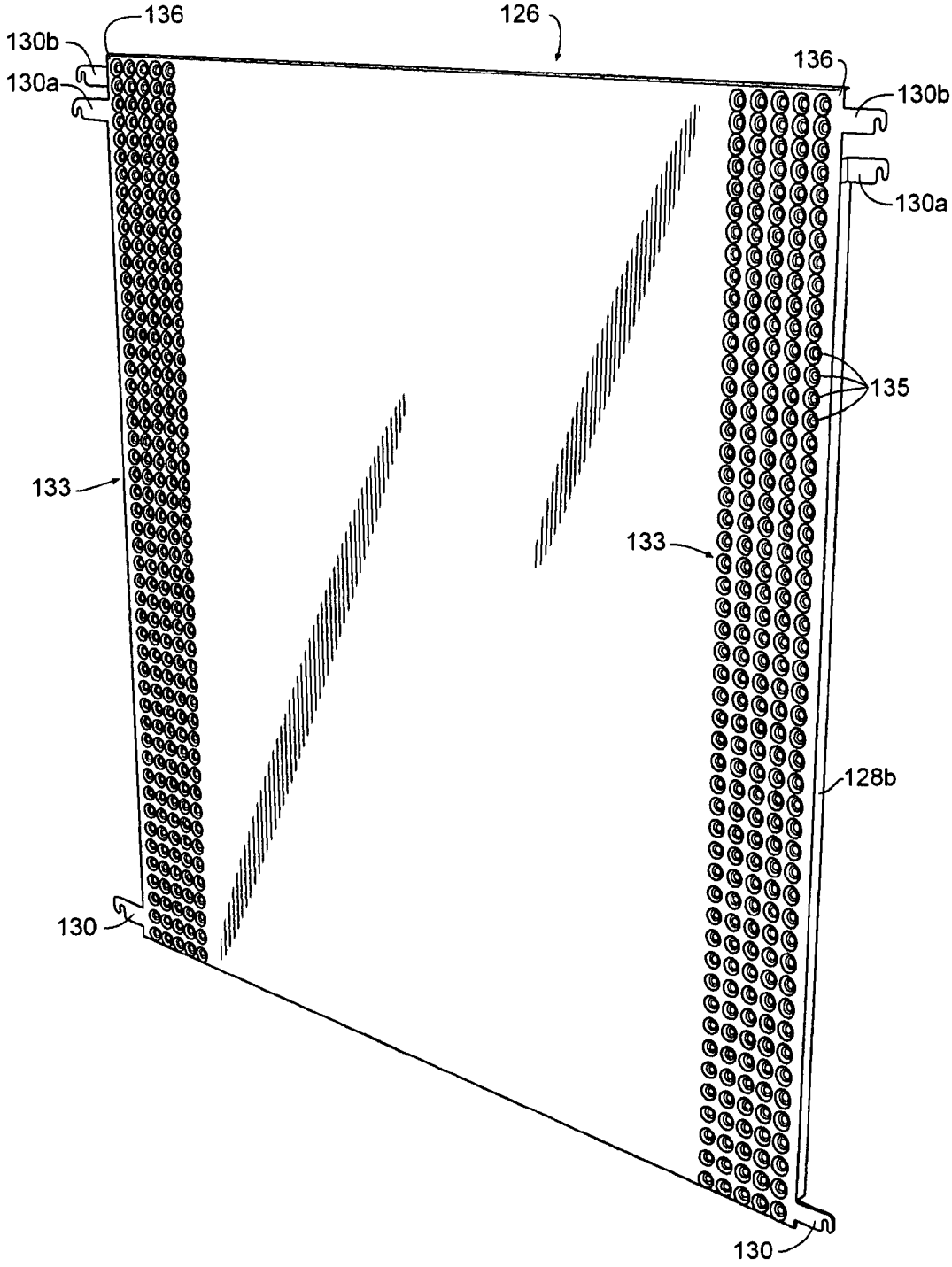
FIG. 10 is a perspective view from above right of the back member shown in FIG. 7.
Figure 13:
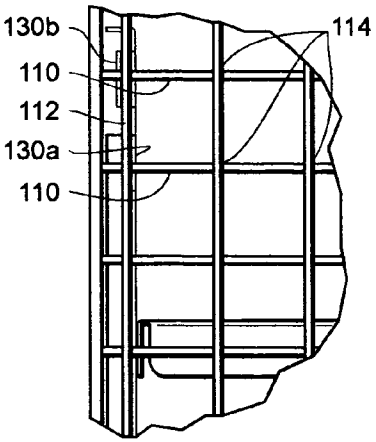
FIG. 13 is a detailed view taken in Circle 13 in FIG. 11.
Figure 14:
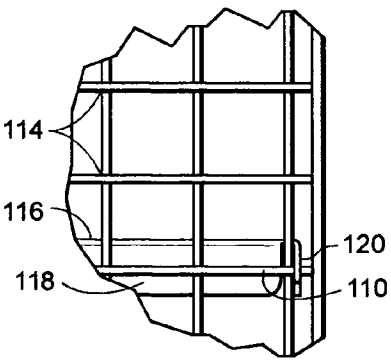
FIG. 14 is a detailed view taken in Circle 14 in FIG. 11.
Figure 12:
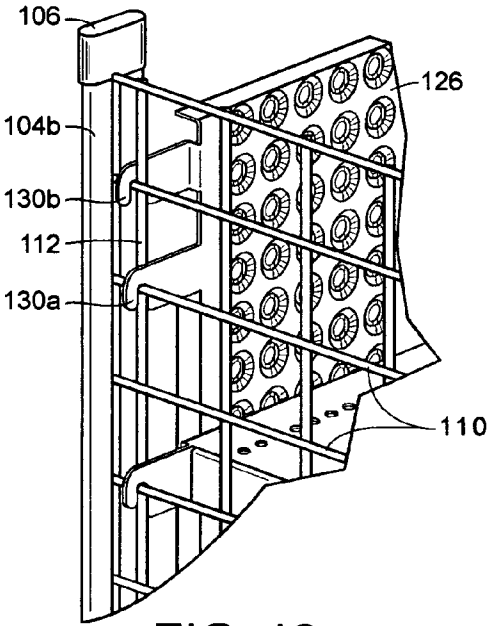
FIG. 12 is a detailed view taken in Circle 12 in FIG. 3.
Figure 11:
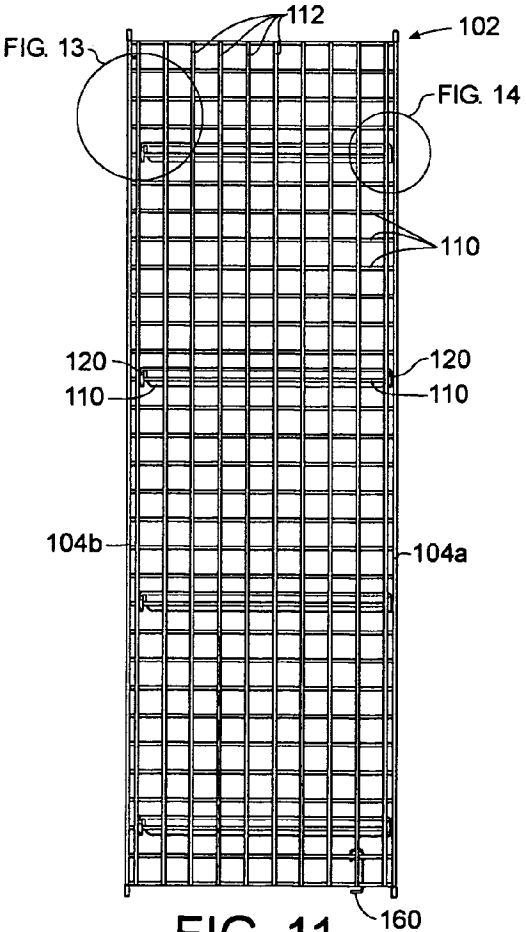
FIG. 11 is an elevational view from the side of the shelving assembly shown in FIGS. 3 and 4.

In a currently-preferred embodiment, the upper corner regions 136 of back member 126 include first and second formed hooks 130*a*,130*b*. Hooks 130*a* are formed as planar extensions of the sheet stock from which back member 126 is stamped. Hooks 130*b* are formed by folding from skirts 128*a*,128*b* and are spaced apart from hooks 130*a* by approximately the thickness of a vertical rod 112 (FIGS. 7 and 8). When back member 126 is installed, hooks 130*a*, 130*b* rest on adjacent horizontal rods 110 and also straddle a vertical rod 112, as shown in detail in FIGS. 12 and 13, thus preventing motion of the back member in the Y direction and preventing rhombic distortion in both the X and Z directions. Preferably, hook 130*a* is above hook 130*b* at one upper corner of back member 126, and hook 130*b* is above hook 130*a* at the other upper corner of back member 126, as shown in FIG. 10.

In a currently preferred embodiment, back member 126 is punched to form one or more arrays 133 of recessed holes 135 for receiving pegboard hangars (not shown) as are known in the prior art.

Back member 126 may be of any desired height up to the full height of vertical support members 102.

Optionally, system 100 may include a kick plate 160 formed as a closed box element having hook elements 162 similar to hook elements 120,130, and a restraining tab 164 extending therefrom for engaging grids 108.

Figure 15:
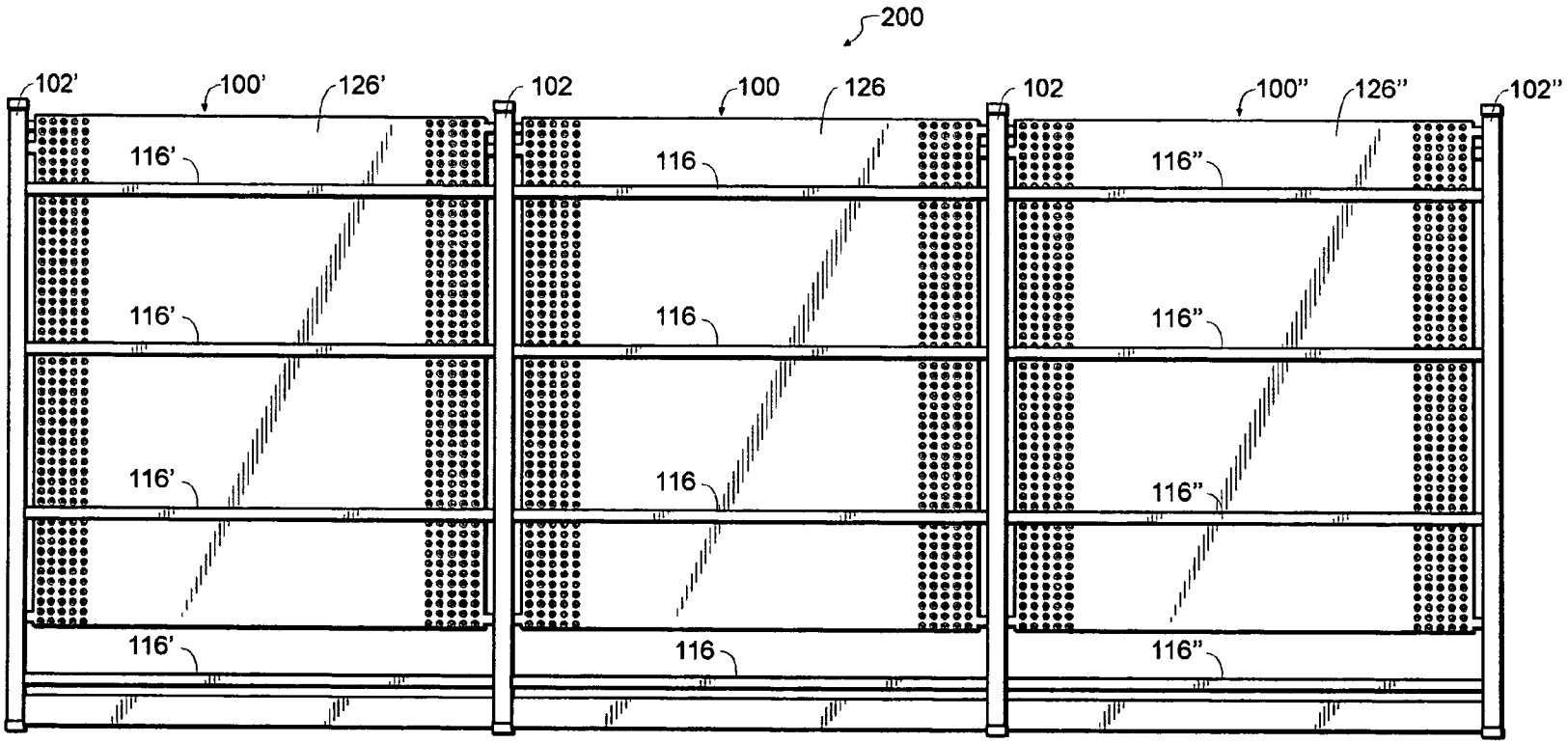
FIG. 15 is a front elevational view of a ganged shelving system comprising three system modules in accordance with the invention as shown in FIGS. 3 and 4.

Referring to FIG. 15, a three-module shelving assembly 200 demonstrates the important modularity of a shelving system in accordance with the invention. A central shelving assembly is identical with system 100 as shown in FIGS. 1 and 2. First and second peripheral shelving assemblies 100' and 100" are formed by providing two additional vertical support members 102',102", two additional back members 126',126", and a plurality of additional shelves 116',116", all of which are identical with the corresponding elements of central assembly 100. Note that the reversed offset between back member hooks 130*a*,130*b* at the upper back member corners 136, as shown in FIG. 10 and described above, permits ganging of adjacent back members on common vertical and horizontal rods of a vertical support member.

Thus, additional shelving is readily provided by simply hooking additional back members and shelves to an existing vertical support element 102 and providing a single additional vertical support element 102',102".

From the foregoing description it will be apparent that there has been provided an improved system of shelving. Variations and modifications of the herein described shelving system will undoubtedly suggest themselves to those skilled in this art. Accordingly, the foregoing description should be taken as illustrative and not in a limiting sense.

What is claimed is:

1. A modular shelving system comprising:

a) a plurality of spaced-apart vertical support members, each of said members including first and second posts connected by a welded wire grid attached therebetween and formed of vertical and horizontal wires;

b) at least one shelf element disposed between adjacent ones of said spaced-apart vertical support members, said shelf element being formed from sheet metal stock and having sheet metal hooks formed from said sheet metal stock extending therefrom for removably engaging horizontal wires in said adjacent spaced-apart support members; and c) a vertical back member disposed between said adjacent spaced-apart vertical support members and being removably attachable thereto, said vertical back member being formed from sheet metal stock and having sheet metal hooks formed from said sheet metal stock extending therefrom for removably engaging horizontal wires in said adjacent spaced-apart support members.

2. A modular shelving system in accordance with claim 1 comprising first and second said spaced-apart vertical support elements, said shelf element being disposed therebetween.

3. A modular shelving system in accordance with claim 2 comprising a plurality of said shelf elements disposed between said first and second vertical support elements.

4. A modular shelving system in accordance with claim 1 wherein said shelf element includes one of said hooks extending from each of four corner regions of said shelf element.

5. A modular shelving system in accordance with claim 4 wherein said shelf element includes a formed sheet metal skirt around edges of said sheet metal shelf element and wherein said hooks define extensions of said sheet metal skirt.

6. A modular shelving system in accordance with claim 1 wherein said sheet metal back member includes one of said sheet metal hooks extending from each of four corner regions of said sheet metal back member.

7. A modular shelving system in accordance with claim 6 wherein said sheet metal back member includes a formed sheet metal skirt around edges of said sheet metal back member.

8. A modular shelving system in accordance with claim 7 wherein upper corner regions of said sheet metal back member include first and second hooks, said first hooks being formed as planar extensions of said sheet metal stock from which said sheet metal back member is formed, and said second hooks being formed from said sheet metal forming said skirt.

9. A modular shelving system in accordance with claim 8 wherein said first and second hooks are spaced apart horizontally by approximately the thickness of one of said vertical wires.

10. A modular shelving system in accordance with claim 9 wherein said first and second hooks are spaced apart vertically by approximately the spacing of adjacent of said horizontal wires in said grid.

11. A modular shelving system in accordance with claim 1 further comprising a kick plate element disposed between said adjacent ones spaced-apart vertical support members and below said shelf element, said kick plate element being formed from sheet metal stock and having sheet metal hooks extending therefrom for removably engaging horizontal wires in said adjacent spaced-apart support members.

* * * * *